United States Patent [19]

Kitchens et al.

[11] Patent Number: 5,042,986

[45] Date of Patent: Aug. 27, 1991

[54] WRINKLE RESISTANT CELLULOSIC TEXTILES

[75] Inventors: John D. Kitchens; Robert T. Patton, both of Lake Jackson, Tex.; Bassam S. Nadar, Midland, Mich.

[73] Assignee: The Dow Chemical Company, Midland, Mich.

[21] Appl. No.: 421,206

[22] Filed: Oct. 13, 1989

[51] Int. Cl.[5] ..... D06M 43/00

[52] U.S. Cl. ..... 8/120; 8/116.1; 8/127.1

[58] Field of Search ..... 8/120, 127.1

[56] References Cited

U.S. PATENT DOCUMENTS 4,820,307 4/1989 Welch et al. ..... 8/120

*Primary Examiner*—Prince E. Willis

*Assistant Examiner*—John F. McNally

[57] ABSTRACT

A process for imparting wrinkle resistance and smooth drying properties to cellulose textiles by crosslinking the cellulose with a cyclic aliphatic polycarboxylic acid having at least two adjacent carboxyl groups in the trans configuration relative to each other, and the resulting crosslinked textile.

9 Claims, No Drawings

WRINKLE RESISTANT CELLULOSIC TEXTILES

FIELD OF THE INVENTION

The present invention relates a novel means for imparting wrinkle resistance and smooth drying properties to a cellulosic textile. More particularly, the invention is concerned with the use of certain cyclic polycarboxylic acids having at least two adjacent carboxyl groups in the trans configuration relative to each other to provide a crosslinking of cellulose so as to develop wrinkle resistance.

BACKGROUND OF THE INVENTION

The use of polycarboxylic acids with or without catalysts in pad, dry and cure treatments to impart wrinkle resistance to cotton fabric was studied by Gagliardi and Shippee, *American Dyestuff Reporter* 52, p 300–303, (1963). They observed small increases in fabric wrinkle resistance after relatively long periods of heating, and noted larger fabric strength losses than are obtained with formaldehyde-based crosslinking agents. These excessive strength losses and the low yield of crosslinkages were attributed to the long heat curing times needed with the inefficient catalysts then available.

A more rapid and effective curing process for introducing ester crosslinks into cotton cellulose was described by Rowland et al, *Textile Research Journal* 37, p 933–941, (1967). Polycarboxylic acids were partially neutralized with sodium carbonate or triethylamine prior to application to the fabric in a pad, dry and heat cure type of treatment. Crosslinking of cellulose was obtained whenever the polycarboxylic acid contained three or more carboxyl groups suitably located in each molecule. With certain polycarboxylic acids, a useful level of wrinkle resistance was imparted. The conditioned wrinkle recovery angle was measured before and after five laundering cycles, and was found to decrease somewhat as a result of laundering, even though no loss of ester groups was detected. Neutralization of carboxyl groups with 2% sodium carbonate even at room temperature caused a 30% loss of ester groups. This indicates a lack of durability of the finish of alkaline solutions such as solutions of alkaline laundering detergents. The curing time needed in fabric finishing was moreover too long to permit high speed, mill-scale production.

Subsequently it was shown by Rowland and Brannan, *Textile Research Journal* 38, p 634–643, (1968), that cotton fabrics given the above cellulose crosslinking treatment with polycarboxylic acids were recurable. Creases durable to 5 laundering cycles could be put into the fabrics by wetting the latter, folding, and applying a heated iron. Evidence was obtained that the ester groups and adjacent unesterified hydroxyl groups on cotton cellulose.

These findings were elaborated by Rowland et al, U.S. Pat. No. 3,526,048. Sodium carbonate or triethylamine were again the examples of bases used to partially neutralize the polycarboxylic acid subsequently applied as the cellulose crosslinking agent. Rowland et al defined their process as requiring neutralization of 1% to 50% of all carboxylic acid functionality by a "strong base" selected from the group consisting of alkali metal hydroxides, carbonates, bicarcarbonates, acetates, phosphates and borates, prior to impregnating the fibrous cellulose with the aqueous polycarboxylic acid and heating to induce crosslinking. A strong base selected from the group consisting of ammonia and certain amines also was indicated as suitable for the partial neutralization of the polycarboxylic acid.

Stated limitations of the process of Rowland et al are that the process cannot be conducted with acids of fewer than three carboxyl groups per molecule, or with acids containing olefinic unsaturation or hydroxyl groups. The reasons were lack of reaction with cellulose chains for development of high levels of wrinkle resistance.

U.S. Pat. No. 4,820,307 to Welch et al discloses as cellulose crosslinking agents polycarboxylic acids which include aliphatic, alicyclic and aromatic acids. However, the acids are either olefinically saturated or unsaturated with at least three carboxyl groups per molecule or with two carboxyl groups per molecule if a carbon-carbon double bond is present alpha, beta to one or both carboxyl groups. An additional requirement is stated for esterifying cellulose hydroxy groups is that in an aliphatic or alicyclic acid a given carboxyl group must be separated by no less than 2 carbon atoms and no more than three. It is further stated that when two carboxyl groups are both connected to the same ring. The two carboxyl groups must be in the cis configuration relative to each other if they are to interact in a manner to form anhydrides which can esterify with cellulosic hydroxyl groups as proposed.

Surprisingly, according to the present invention, it has been discovered that effective crosslinking of the cellulosic hydroxyl group occurs with cyclic aliphatic polycarboxylic acids when two adjacent carboxyl groups are in the trans configuration.

U.S. Pat. No. 3,203,886 to Griffin discloses a photodimerization process for preparing the trans polycarboxylic acids used in the present invention.

It is understood that the term "wrinkle resistance" is defined pursuant to AATCC Method No. 66-1984, 1988. Technical Manual, American Association of Textile Chemists and Colorists, Research Triangle Park, N.C., which is herein incorporated by reference.

SUMMARY OF THE INVENTION

This invention relates to cellulosic textile materials and to a process for durably imparting to cellulosic textile materials, such as cotton and rayon, a high level of wrinkle resistance and smooth drying properties by means of cyclic aliphatic hydrocarbons of 4 to 6 carbon atoms having 4 or more carboxyl groups wherein at least two are adjacent carboxyl groups.

More particularly, the process of the invention consists of reacting a cyclic aliphatic polycarboxylic acid having 4 or more carboxyl groups wherein at least two adjacent carboxyl groups are in the trans configuration relative to each other with a cellulosic textile material in the presence of a curing catalyst at elevated temperatures. The material is impregnated with an aqueous treating solution containing the polycarboxylic acid and the curing catalyst and then heat cured to produce esterification and crosslinking of the cellulose with the polycarboxylic acid.

Advantageously, at least 2 of the carboxyl groups of the polycarboxylic acid being in a trans configuration, provides a more economic means for crosslinking cellulosic materials. The process of the invention advantageously utilizes about 0.3–11% by weight of a curing catalyst in the treating solution. Curing catalysts which may be utilized are disclosed in U.S. Pat. No. 4,820,307, which is herewith incorporated by reference. The curing catalysts include for example, alkali metal hypophosphites such as sodium hypophosphite, alkali metal phosphites such as disodium hypophosphite, alkali metal salts of polyphosphoric acid such as diisosodium acid pyrophosphate, sodium hexametaphosphate, and the like, and alkali metal dihydrogen phosphates, such as sodium or potassium dihydrogen phosphates.

Examples of the polycarboxylic acids which are included within the scope of the invention are as follows: trans-1,2,3,4-cycloalkyl tetracarboxylic acid such as trans-1,2,3,4-cyclobutane tetracarboxylic acid, trans-1,2,3,4-cyclopentane tetracarboxylic acid, trans-1,2,3,4-cyclohexane tetracarboxylic acid, trans-1,2,3,4,5-cyclopentane pentacarboxylic acid, trans-1,2,3,4,5-cyclohexane pentacarboxylic acid, trans-1,2,3,4,5,6-cyclohexane hexacarboxylic acid, and the like, cis-1,2-trans-3,4-cyclobutane tetracarboxylic acid, cis-1,2-trans-3,4-cyclopentane tetracarboxylic acid, cis-1, 5-trans-2,3,4-cyclopentane pentacarboxylic acid, cis-1, 6-trans-2,3,4-cyclohexane pentacarboxylic acid and cis-1,2,3-trans-4,5,6-cyclohexane hexacarboxylic acid, and the like.

The concentration of polycarboxylic acid used in the treating solution is generally in the range of about 1 to 20% by weight depending on the polycarboxylic acid and the degree of crosslinking desired. The concentration of polycarboxylic acid is also dependent upon the amount of cellulosic fibers in the textile material. Preferably, the textile material comprises at least about 30% by weight of cellulosic fibers.

DESCRIPTION OF THE PREFERRED EMBODIMENTS

The present invention provides a process for imparting wrinkle resistance and smooth drying properties to cellulosic textiles comprising cellulosic fibers selected from the group consisting of cotton, rayon, flax, jute, hemp, ramie and the like. The process is advantageously used with textiles comprising 30–100% cellulosic materials.

More particularly, there is provided in the process of the invention an aqueous treating solution containing about 0.1 to 20% by weight of a cyclic aliphatic hydrocarbon of 4 to 6 carbon atoms having 4 or more carboxyl groups wherein at least two adjacent carboxyl groups are in the trans configuration relative to each other. The treating solution includes a suitable curing agent which is the alkali metal dihydrogen phosphates or the alkali metal salts of phosphorous, hypophosphorous and polyphosphoric acid in an amount of about 0.3 to 11% by weight.

The process is carried out by first impregnating the cellulosic material with the aqueous treating solution. Excess liquid is removed and the material is dried to remove the solvent. The material is then oven-cured at about 150–240 degrees Celsius for 5 seconds to 30 minutes to cause cellulose esterification and crosslinking.

In the following examples, all parts and percentages are by weight. The examples are merely illustrative of the process of the present invention. Changes and modifications in the specifically described embodiments can be carried out without departing from the scope of the invention which is intended to be limited only by the scope of the claims.

EXAMPLE 1

A. Five grams of trans-1,2,3,4-cyclobutane tetracarboxylic acid (CBTCA), available from the Aldrich Chemical Company, were added to 72.2 grams of deionized water in a stirred beaker. The substance went completely into solution a room temperature. To this solution was added 2.17 grams of sodium hypophosphite, which amounted to approximately one mole of sodium hypophoshite per 3.5 moles of carboxylic acid functionality. The pH of this solution was about 2.0. Three specimens of Testfabric® style #400 cotton print cloth were treated by dipping into the solution and passing through a padder to produce a moisture uptake of 105–110%. This procedure was repeated once. The specimens were stretched on a rack and dried in a gravity convection oven at 110 degrees Celsius for 20 minutes. Then they were heated in a textile oven under the time and temperature conditions shown in Table 1. Following this heat treatment, the specimens were washed in a stirred beaker containing 4.0 liters of deionized water at 55 degrees Celsius for a period of 30 minutes. Each piece of cloth was then rinsed under a running deionized water tap for about 30 seconds then dried on a rack in a gravity convection oven for twenty minutes, taken out and allowed to cool then placed in a constant humidity chamber controlled at 65% relative humidity at 22 degrees Celsius for 24 hours. Wrinkle resistance was then determined by AATCC method #66-1984. This method is used to determine the wrinkle recovery angle (WRA) of textiles. Wrinkle resistance of woven textiles is stated in terms of wrinkle recovery angle. The higher the wrinkle recovery angle, the greater is the wrinkle resistance of the fabric. Results of this determination are shown in Table 1. One of the specimens was subjected to thirty laundering cycles in a conventional household clothes dryer, placed in a constant humidity chamber at 65% relative humidity for 24 hours, then re-evaluated for wrinkle resistance by AATCC method #66-1984. This was compared to a specimen of identical cloth treated in an identical manner but with trans-1,2,3,4 butane tetracarboxylic acid instead of the "trans" cyclic compound. Results of this comparison between trans 1,2,3,4-cyclobutane tetracarboxylic acid and trans-1,2,3,4 butane tetracarboxylic acid are shown in Table 2. It can be seen that the wrinkle resistance produced by treatment with the two compounds is nearly the same hence it can be concluded that the two compounds produce the same level of crosslinking with similar proportions of ester linkages. For purposes of comparison, Table 2 also shows the WRA of Testfabric® style #400 cotton print cloth crosslinked with dimethylol dihydroxyethyleneurea (C-tron CR-4 available from Pat Chem Inc.) applied in two different concentrations according to the manufacturer's recommendations.

B. In order to demonstrate the comparable effect which crosslinking with trans-1,2,3,4-cyclobutane tetracarboxylic acid has on the physical strength of Testfabric® style #400 print cloth, its tearing strength was compared with that of the same type of cloth treated with aliphatic 1,2,3,4-butane tetracarboxylic acid and fabric treated with two different concentrations of dimethylol dihydroxyethyleneurea, (DMDHEU). The DMDHEU used here is a product commercially available from Pat-Chem, Inc. under the product name "C-tron CR-4". This is a pre-catalyzed resin with an activity of about 35%. It is applied in a double dip, double nip procedure at a wet pickup of about 110%. After applying the resin solution, and dried and cured in one step in a textile oven at 320 degrees Fahrenheit for 2.5 minutes. Then the material is stirred in deionized water at 50 degrees Celsius for thirty minutes, rinsed by holding under a deionized water tap for about 30 seconds then stretched and dried in a gravity convection oven for 30 minutes. Before taking measurements on the specimens, they were placed for 24 hours in a constant humidity chamber controlled at 65% relative humidity.

Measurement of tearing strengths was made using an Elmendorf tear tester manufactured by Testing Machines, Inc. and following TMI method 83-10.

Likewise comparisons in whiteness of fabric treated with trans-1,2,3,4-cyclobutane tetracarboxylic acid, trans-1,2,3,4-butane tetracarboxylic acid, and DMDHEU were made after thirty laundering cycles using a household automatic clothes washing machine. Whiteness index and yellowness index measurements were made using a Hunter model D25-PC2 colorimeter and following the method described in *Hunterlab* D25-PC2, Hunter Associates Laboratories, Inc, Reston, VA, which is herein incorporated by reference. Results of these tests are shown in Table 4.

TABLE 1

Conditions for Treatment of Testfabric Style #400 Cotton Print Cloth With Trans- 1,2,3,4-Cyclobutane Tetracarboxylic Acid and wrinkle recovery angles (WRA)

| treatment | % wet uptake | temperature | time | WRA |
|---|---|---|---|---|
| CBTCA | ~110% | 180 | 60 sec | 267 |
| CBTCA | ~110% | 200 | 30 sec | 274 |
| CBTCA | ~106% | 235 | 15 sec | 294 |
| control | 0 | 180 | 60 sec | 170 |
| control | 0 | 200 | 30 sec | 174 |
| control | 0 | 235 | 15 sec | 157 |
| control | 0 | no heat treatment | | 168 |

TABLE 2

Wrinkle Resistance Comparison by AATCC Test Method #66-1984 Wrinkle Recovery Angle (WRA)

| Specimen treatment | WRA before 30 laundry cycles | WRA after 30 laundry cycles | % change |
|---|---|---|---|
| CBTCA | 294 | 250 | −15% |
| BCTA | 283 | 248 | −12% |
| DMDHEU 10% | 238 | 220 | −7.5% |
| DMDHEU 15% | 267 | 243 | −9% |
| DMDHEU 20% | 267 | 255 | −5 |

TABLE 3

Elmendorf Tear Strength of Cotton Print Cloth After 30 Launderings

| Specimen | heat treatment | tear strength warp | tear strength fill |
|---|---|---|---|
| CBTCA | 200 30 sec | 15 gm/cm | 10 gm/cm |
| BTCA | 200 30 sec | 9 gm/cm | 13 gm/cm |
| DMDHEU 10% | C-tron CR4 | 9 gm/cm | 13 gm/cm |
| DMDHEU 20% | C-tron CR4 | 8 gm/cm | 13 gm/cm |
| DMDHEU 20% | C-tron CR4 | 30 gm/cm | 23 gm/cm |
| control | | 30 gm/cm | 23 gm/cm |

TABLE 4

Whiteness Comparison of Style #400 Cotton Print Cloth

| Specimen | Whiteness Index | Yellowness Index |
|---|---|---|
| CBTCA | 75.6 | 3.06 |
| BTCA | 79.3 | 2.04 |
| control | 78.6 | 1.9 |

What is claimed is:

1. A process for treating a cellulosic textile material so as to impart wrinkle resistance and smooth drying properties comprising the steps of:

A. treating said cellulosic textile material with an aqueous solution comprising trans-1,2,3,4-cyclobutane tetracarboxylic acid, and a curing catalyst, and B. heating the treated material so as to produce esterification and crosslinking of said material with said acid.

2. The process of claim 1 wherein said curing agent is selected from the group consisting of alkali metal hypophosphites, alkali metal phosphite, alkali metal salts or polyphosphoric acid and alkali metal dihydrogen phosphates.

3. The process of claim 2 wherein said curing agent is sodium hypophosphite.

4. The process of claim 1 wherein said cellulosic textile material comprises cellulosic fibers selected from the group consisting of cotton, flax, rayon, jute, hemp and ramie.

5. The process of claim 4 wherein said cellulosic fibers are cotton.

6. The process of claim 1 wherein said treating solution comprises about 1 to 20% by weight of said acid.

7. A wrinkle resistant and smooth drying cellulosic textile material comprising a cellulosic textile material crosslinked with trans-1,2,3,4- cyclobutane tetracarboxylic acid.

8. The material of claim 7 wherein said cellulosic textile material comprises cellulosic fibers selected from the group consisting of cotton, flax, rayon, jute, hemp and ramie.

9. The material of claim 7 said cellulosic fibers are cotton.

* * * * *